362-113 SR
5/6/86 XR 4,586,715

United States Patent [19]

Scolari et al.

[11] Patent Number: 4,586,715

[45] Date of Patent: May 6, 1986

[54] TOY LASER PISTOL

[75] Inventors: John E. Scolari, La Mesa; Robert T. Warner, Poway; Joe E. Deavenport, San Diego, all of Calif.

[73] Assignee: Life Light Systems, San Diego, Calif.

[21] Appl. No.: 618,309

[22] Filed: Jun. 7, 1984

Related U.S. Application Data

[63] Continuation-in-part of Ser. No. 454,617, Dec. 30, 1982, abandoned.

[51] Int. Cl.[4] ..... F41J 5/02

[52] U.S. Cl. ..... 273/311; 434/21; 362/84; 362/112; 362/113; 273/DIG. 24

[58] Field of Search ..... 273/310, 311, 312, DIG. 24, 273/1 E; 434/21, 22; 362/84, 110, 112, 113

[56] References Cited

U.S. PATENT DOCUMENTS

| | | | |
|---|---|---|---|
| 2,236,390 | 3/1941 | Wood et al. | 273/310 |
| 2,358,867 | 9/1944 | Madan | 362/84 X |
| 3,220,732 | 11/1965 | Pincus | 362/112 X |
| 3,294,401 | 12/1966 | Nicholas et al. | 273/311 |
| 3,447,033 | 5/1969 | Redmond et al. | 434/21 X |
| 3,633,285 | 1/1972 | Sensney | 273/310 X |
| 3,655,192 | 4/1972 | Hall et al. | 273/311 X |
| 4,236,348 | 12/1980 | DuLac | 273/310 X |
| 4,365,439 | 12/1982 | Litynski | 273/310 X |
| 4,373,916 | 2/1983 | Ashford et al. | 434/22 |
| 4,403,777 | 9/1983 | Del Principe et al. | 273/1 E |
| 4,487,583 | 12/1984 | Brucker et al. | 273/311 |

FOREIGN PATENT DOCUMENTS

| | | | |
|---|---|---|---|
| 2081069 | 2/1982 | United Kingdom | 362/84 |

*Primary Examiner*—Richard C. Pinkham
*Assistant Examiner*—MaryAnn Stoll Lastova
*Attorney, Agent, or Firm*—Baker, Maxham & Jester

[57] ABSTRACT

A toy laser weapon such as a pistol utilizes a flash unit to generate a burst of high intensity light. A collimating device collimates the light into a beam simulating a laser beam. A target vest can be worn by the person that is the target of the simulated laser pistol and includes a target area of fluorescent material that indicates a hit when the light beam from the toy laser pistol strikes the target area. Also, a sound generator can be provided to emit a sound when the burst of light occurs. An exemplary circuit for use with the light pistol is also part of the invention.

38 Claims, 10 Drawing Figures

TOY LASER PISTOL

CROSS REFERENCE TO RELATED APPLICATION

This is a Continuation-in-Part of application Ser. No. 454,617, filed Dec. 30, 1982, now abandoned.

BACKGROUND OF THE INVENTION

The present invention relates to a toy laser weapon that generates a simulated laser beam which is particularly realistic and the circuit for use therewith. A target vest can be worn to indicate a hit by the simulated laser beam.

Children are captivated with space age technology, and the demand for space age toys has vastly increased with the advent of movies and television programs such as "Star Trek" and "Battle Star Galactica." Children are becoming more sophisticated and there is a great demand for realism in the toy market. Toys that look and act like simulations are not acceptable in the marketplace today. Many toys are currently available using a battery operated incandescent light bulb to simulate laser activity. These toys do not provide the realism desired by the user.

Power supplies have been proposed for electronic flash purposes where the circuit, operating from a power source, functions with means for charging and discharging a capacitor for operating the flash lamp. Typically, many of the systems have had means of some type for sensing the capacitor voltage and disabling or turning off the charging circuit after the capacitor has been fully charged, to save power.

The prior art systems mentioned above generally have limitations which make them not suitable for use with toy weapons which require an immediate bright flash in response to trigger actuation, rapid recharging to afford as much realism as possible for children playing with such toys, and relative light weight. These prior systems typically have a relatively long charging time, between 6 and 30 seconds, or have relatively large sources of power, such as large or bulky batteries, or are connected to an AC power source and are thereby non-portable. Also these systems, in order to achieve the desired results, are frequently quite complex as well as being too large to be employed in a children's toy. Another problem with many prior art systems is that the voltage sensing mechanism is not precise so there is a relatively large swing between full charge of the flash capacitor and the voltage level at which the charge again builds up. They often use a linear technology or a flyback transformer in the feedback circuit.

SUMMARY OF THE INVENTION

An exemplary embodiment of the toy laser weapon of the present invention provides realism through the use of a high energy light source, such as a stroboscopic unit, to emit bursts of high intensity light that are collimated to give a realistic simulation of a laser beam. The embodiment described is in the form of a pistol. Fluorescent target means can be used in combination with the weapon so that a laser hit is visibly registered.

The circuit of this invention comprises a controlled high voltage generator with a rapid charge rate operating at high efficiency while using a low voltage DC power source. The circuit employs an oscillator to drive a DC/AC inverter connected to a low voltage DC power supply, such as a battery, to switch the power supply on and off at the desired frequency. The inverter also boosts the voltage by a factor of 10 to 15 and then a rectifier and voltage multiplier convert the signal to a high level DC voltage which is applied to a storage capacitor. A feedback circuit senses the output of the voltage multiplier and applies that voltage to a Schmitt trigger comparator, the output of which controls the operation of the oscillator.

The efficiency and low power loss aspects of the circuit and its components help make this voltage generator particularly adaptable for small toys where a rapid recharging rate is necessary, and for portable emergency flash units.

BRIEF DESCRIPTION OF DRAWING

The objects, advantages and features of this invention will be better understood from the following detailed description when read in conjunction with the accompanying drawing in which.

DESCRIPTION OF THE PREFERRED EMBODIMENTS

Figures 1, 2, 3:
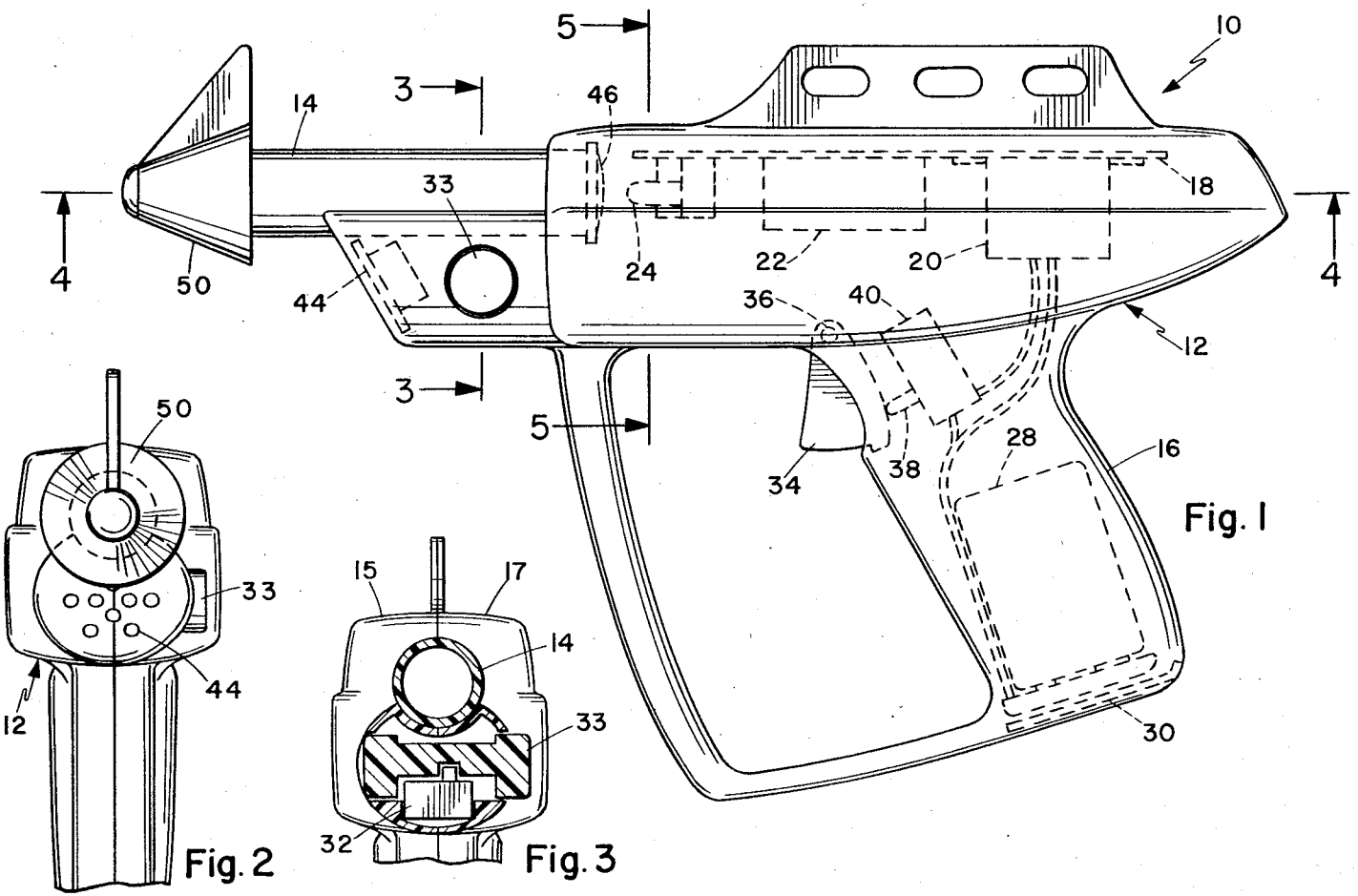
FIG. 1 is a side elevation view of a toy laser weapon in the form of a pistol, constructed in accordance with this invention.
FIG. 2 is a front elevation view of the weapon of FIG. 1.
FIG. 3 is a sectional view taken on line 3—3 of FIG. 1.
Figure 4:
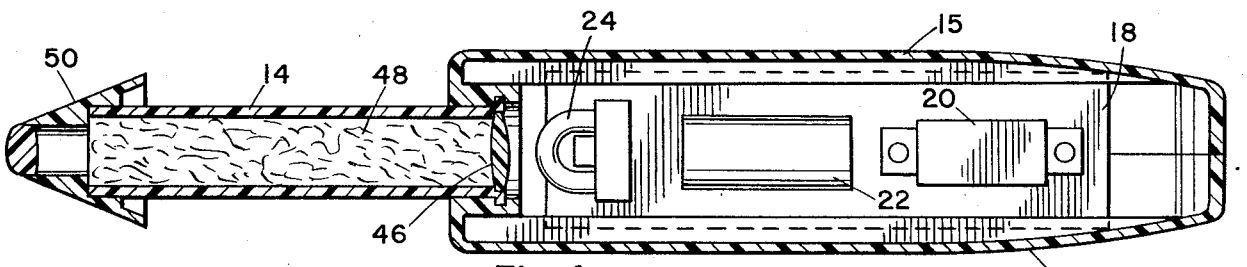
FIG. 4 is a sectional view taken on line 4—4 of FIG. 1.

Referring to the drawing, and more particularly to FIG. 1 thereof, the toy laser weapon 10 is demonstrated in the form of a pistol. The principles discussed herein can be applied to a toy laser rifle or other similar toy laser weapon. The weapon 10 comprises generally a handle portion 12, and a barrel 14. The handle portion could be a rifle stock for example. The handle portion 12 in this instance includes a grip 16. A high energy lighting device such as a stroboscopic unit is used to create bright bursts of light energy simulating a laser beam. The handle portion 16 is formed in half sections 15 and 17 (FIG. 4) that are bonded around the barrel 14 in the assembled condition. The handle portion and barrel are made of a suitable plastic.

Figure 5:
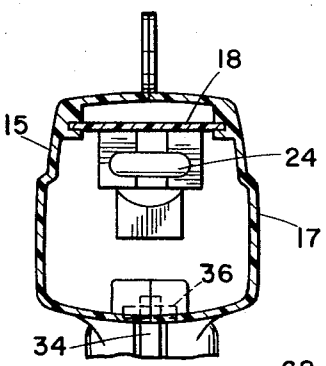
FIG. 5 is a sectional view taken on line 5—5 of FIG. 1.

A flash unit is formed on a printed circuit board 18 and includes strobe lamp actuating elements 20 and 22 of a stroboscopic flash unit, a unit containing high capacitance for storing an electric charge for firing a lamp that produces a high intensity flash immediately upon being triggered. The stroboscopic unit is connected to flash lamp 24. The printed circuit board 18 is seated in notches in the handle portion half sections 15 and 17 as shown in FIG. 5 of the drawing.

Figure 6:
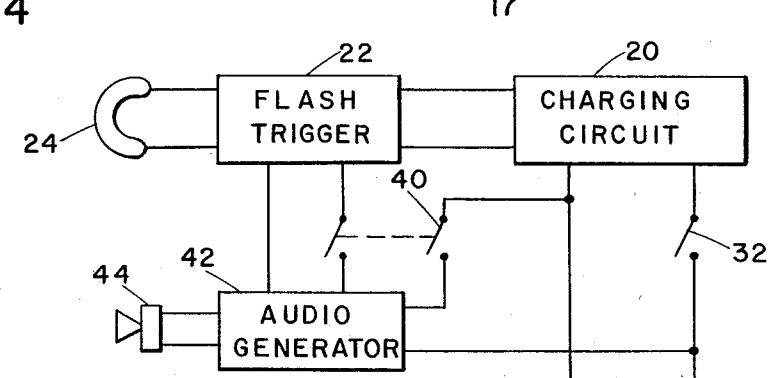
FIG. 6 is a basic block diagram of the electrical circuit of the toy laser weapon of the present invention.

A battery 28 is disposed in a compartment in the grip 16 of the handle portion 12. The battery compartment is closed with a cover 30. The battery charging circuit is enabled by a main power or enabling switch 32 with slide button 33 (FIGS. 1, 3 and 6). This can be a push-button switch or rotating switch as well as the sliding switch which is shown. A trigger 34 is pivotally connected to the handle portion 16 at 36. A spring loaded pin 38 extends out of switch 40. When the trigger 34 is pulled back, the switch 40 is closed, functioning as an actuating switch. At this point, the circuit to the flash lamp 24 and to audio generator 42 is closed, igniting flash lamp 24 and issuing a sound from the audio generator 42 through speaker 44. If desired the speaker could face in a different direction, and may advantageously have its own dedicated battery connected into the circuit. The main power switch 32 could have different configurations and be located in other positions.

The burst of high intensity light from flash lamp 24 passes through collimating lens 46. The handle portion 16 is preferably formed of translucent plastic and the burst of light travels through the collimating lens 46 along barrel 14. The barrel may be transparent or semi-transparent and can be lined with reflective particles 48 if desired to cause the light to bounce about the barrel and give an unusual light bouncing effect around the barrel. The collimated beam of light passes out the end of barrel 14 and simulates a laser beam. The tip 50 is transparent and coated inside with fluorescent material so that the tip glows even after the burst of high intensity light has passed.

The result is a highly realistic simulated laser weapon that emits a burst of high intensity light in a concentrated beam that is realistic. The optional speaker gives an audio indication when the lamp is flashed.

Figure 7:
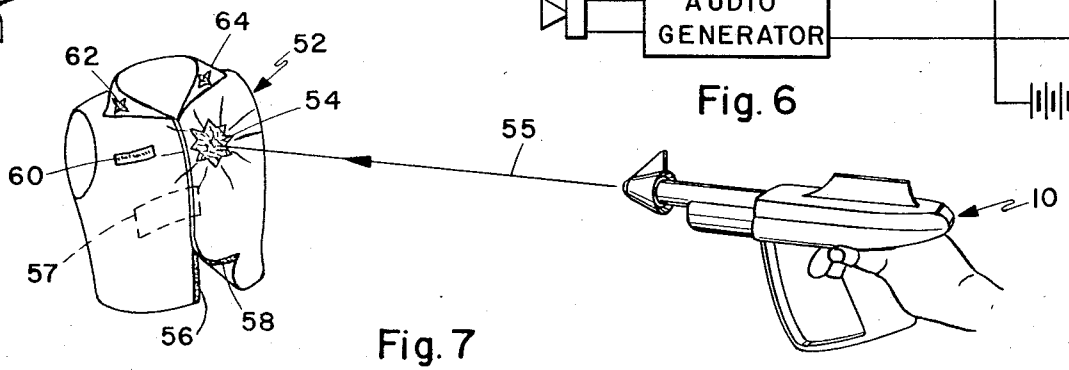
FIG. 7 illustrates operation of the toy laser weapon in conjunction with an optional reflective target vest.

A target in the configuration of a vest is shown at 52 in FIG. 7, and is an optional aspect of the invention. The vest 52 includes a target area 54 of light reflecting or fluorescent material which will glow for a period of time after the light beam 55 strikes it. A similar target area 57 is positioned in the center of the back of the vest 52. The vest is fastened in place with fastener strips 56 and 58, which may be the conventional hook and pile type fastener. A fluorescent name tag is shown at 60 and fluorescent insignia at 62 and 64. The vest 52 adds to the space age atmosphere created in using the toy and records hits by the simulated laser beam 55. The vest 52 also serves as a highly effective protection device for a child when worn at night. When the child is in the street, the light beam of a vehicle strikes the target area 54, tag 60, insignia 62 and 64 and the reflective portion 57 on the back of the vest 52, glowing brightly to indicate the presence of the child.

Figure 8:
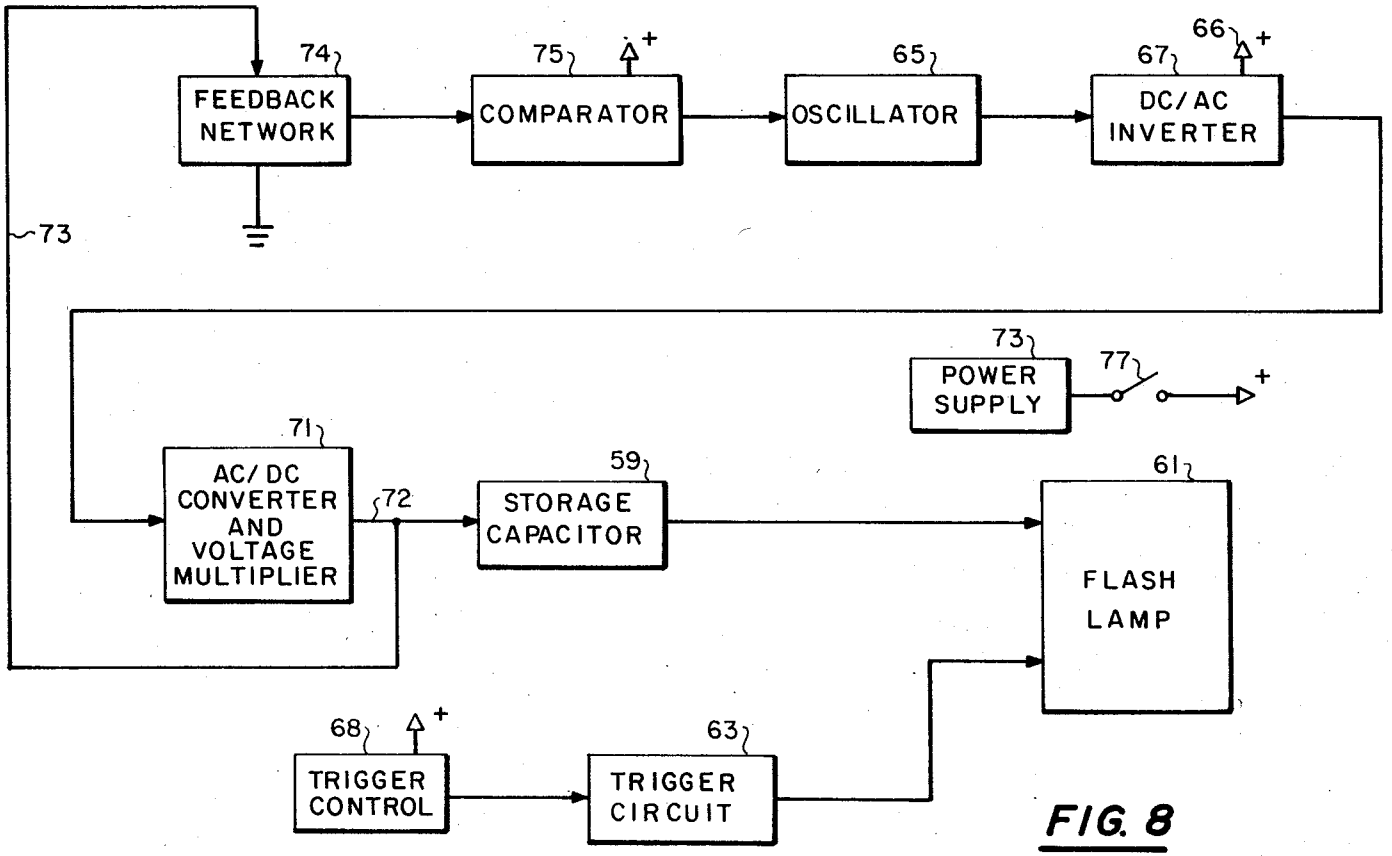
FIG. 8 is a more detailed block diagram of a controlled high voltage generator employed in the laser pistol of FIG. 1.
Figure 9:
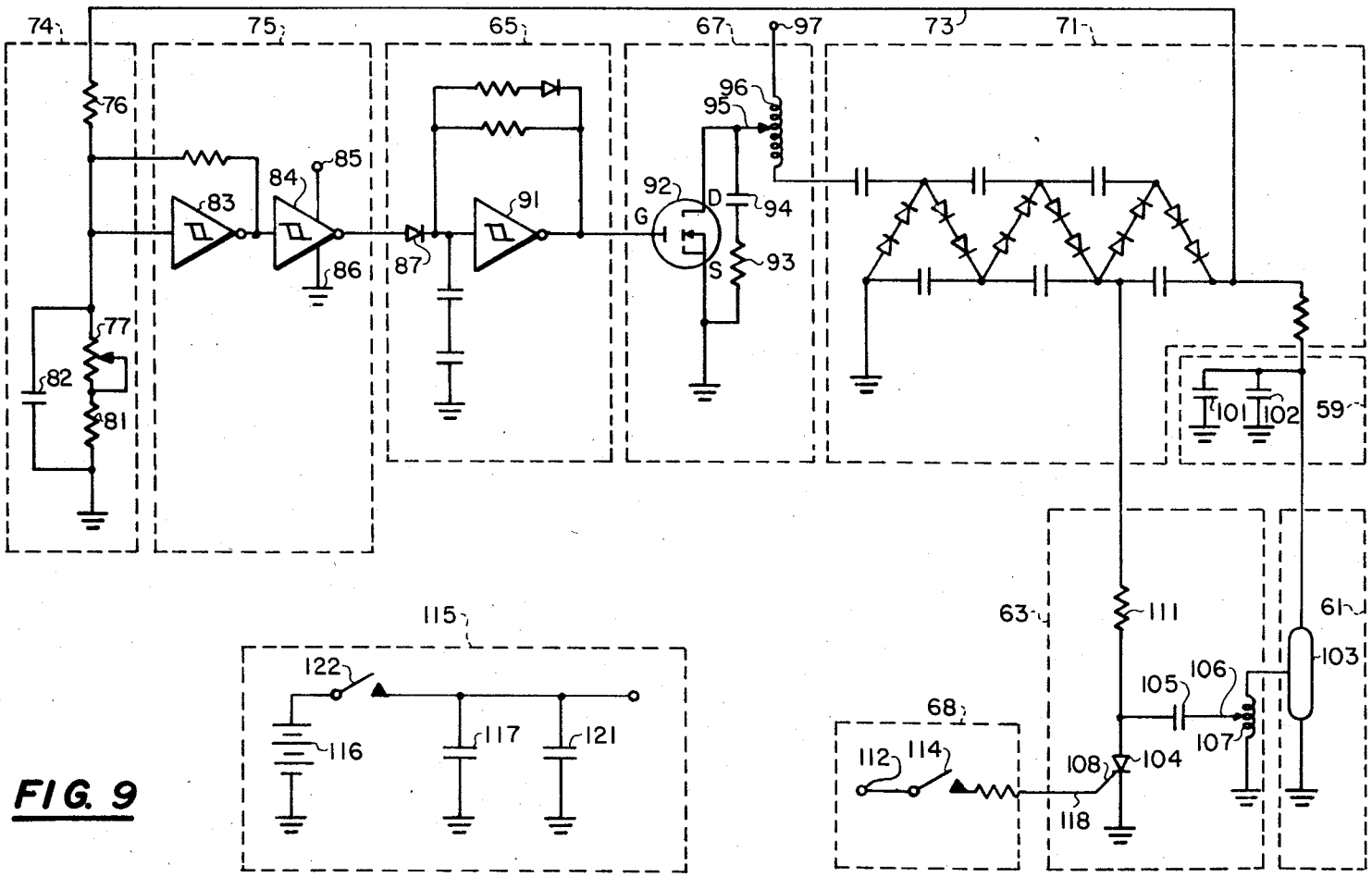
FIG. 9 is a generalized schematic diagram of the generator of FIG. 8.
Figure 10:
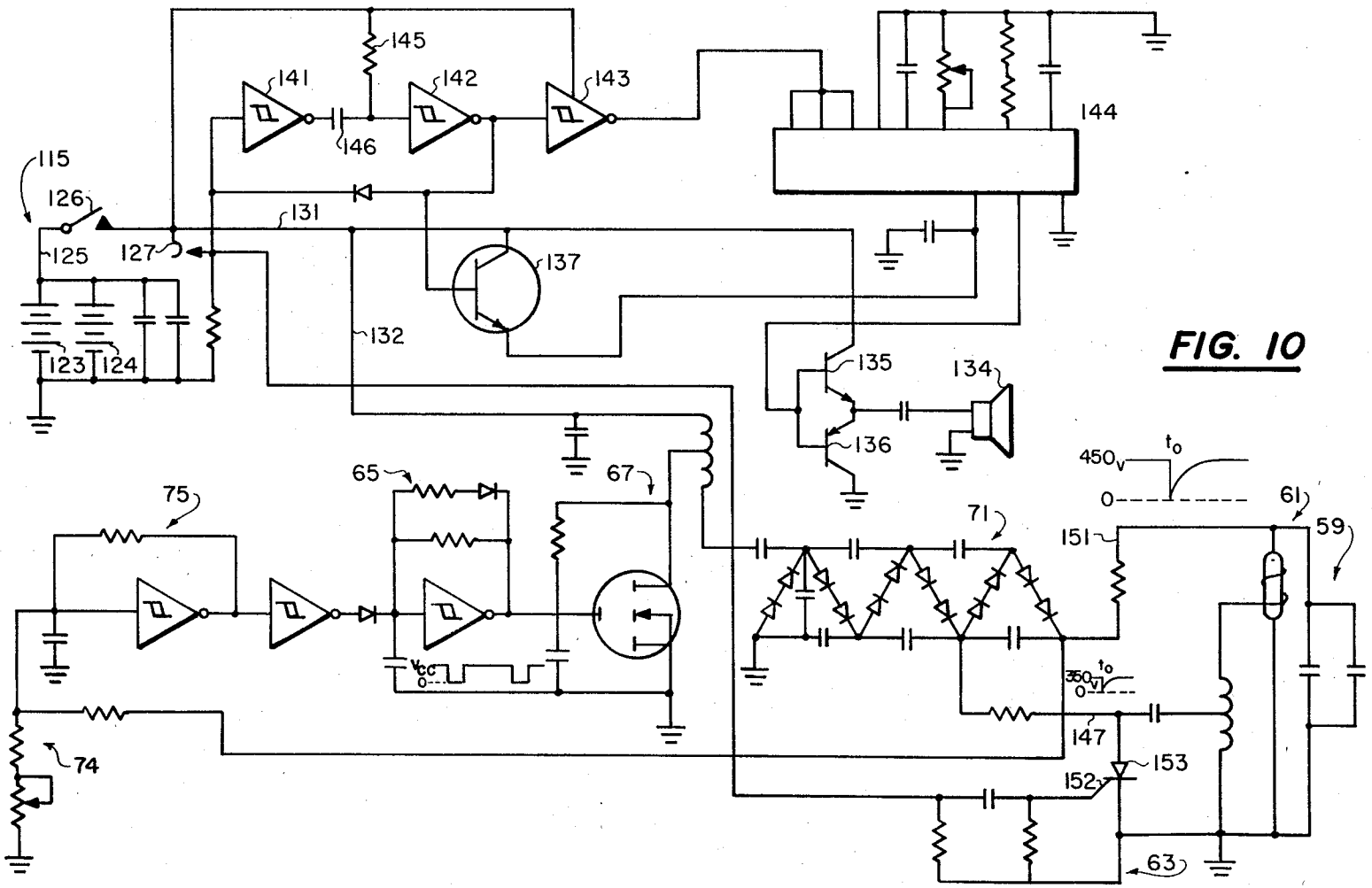
FIG. 10 is a specific schematic diagram of the generator of FIGS. 8 and 9 configured for use in a toy laser pistol.

The high voltage generator used to create the desired short duration, high-intensity flash is shown in FIGS. 8–10. FIG. 8 shows a generalized block diagram of the system for generating flashes. Flash lamp 61 has a high voltage, approximately 450 volts, applied to it from storage capacitor 59. The lamp flashes upon actuation by a signal from trigger circuit 63 which discharges the storage capacitor across the flash lamp causing a substantially instantaneous bright flash. The trigger circuit is actuated by a signal from trigger control 68.

A control signal is applied to the input of oscillator 65 which operates at an appropriate frequency, in the range of 20 to 200 KHz, preferably about 25 KHz. A low DC voltage provided by power supply 78 through enable switch 79 is applied to terminal 66 of DC/AC inverter 67 and, in conjunction with the switching engendered by oscillator 65, the inverter has a substantially amplified AC voltage output, approximately 10 to 15 times its input voltage. The AC output is applied to AC/DC converter/multiplier 71 where the voltage is rectified and multiplied to approximately 450 volts at output 72. This voltage may range from 400 to 475 volts and is applied across storage capacitor 59 to fire the flash lamp when triggered. A feedback loop 73 couples the output of multiplier 71 with feedback network 74, the output of which is applied to comparator 75. When the voltage on storage capacitor 59 reaches the desired level, it is sensed by the feedback network and comparator, and the comparator switches to disable the oscillator. When the voltage on the storage capacitor has been reduced, at least by a predetermined value, either by leakage or by discharge, a lower voltage appearing in the feedback network causes the comparator to switch the oscillator to an oscillating condition and quickly recharge the storage capacitor.

The schematic diagram of FIG. 9 shows a basic example of the components in the blocks of FIG. 8. Feedback network 74 comprises a resistor 76 in series with a potentiometer 77 and another resistor 81. The potentiometer enables the level of voltage detected by the feedback network to be adjusted. Resistors 81 and potentiometer 77 are shunted by capacitor 82.

The feedback network is connected to comparator 75 comprised of Schmitt trigger elements 83 and 84. For convenience, element 84 is shown with a positive voltage input terminal 85 and a ground terminal 86. Actually, each such element in a single chip of many such elements would have the positive and ground terminals. The output of the comparator is fed to diode 87 in oscillator 65, which also comprises a Schmitt trigger element 91. Elements 83, 84 and 91 are part of a single CMOS chip 40106 which is available from a number of different sources. The other diode, resistors and capacitors comprising the oscillator are common elements, typically arranged, and need not be described in detail here.

The output of the oscillator is applied to the gate terminal of field effect transistor (FET) 92, the D and S terminals of which are coupled across a series RC network comprising resistor 93 and capacitor 94. The D terminal of the FET and the RC network are connected to the tap 95 of coil 96. DC voltage from the power supply is applied to one end of coil 96 through terminal 97.

The output of the DC/AC inverter 67 is connected to the input of AC/DC convertor and voltage multiplier 71 which serves to rectify the medium level voltage AC signal out of the inverter and increase the voltage applied to storage capacitor 59 to approximately 450 volts. The storage capacitor is shown as being comprised of two capacitor elements 101 and 102 but this is a matter of design choice as to whether one or more capacitors are used. The charge stored in capacitor 59 is applied across tube 103 of flash lamp 61 and provides a bright flash when fired by means of trigger circuit 63 comprising silicon controlled rectifier (SCR) 104 connected through capacitor 105 to the tap 106 of coil 107. The capacitor is also connected through a resistor 111 back to AC/DC convertor and voltage multiplier 71. When transistor 104 conducts, the charge stored in storage capacitor 105 triggers flash lamp 103 into conduction through trigger coil 107 for an instantaneous brilliant flash.

Trigger circuit 63 is controlled by trigger control 68 comprising DC voltage input terminal 112 connected to lead 118 of transistor 104 through on/off or trigger switch 114.

Power supply 115, which powers the entire high voltage generator, comprises battery 116 shunted by capacitors 117 and 121 through normally closed enable switch 122. Battery 116 may comprise more than one actual battery element, which would normally be connected in parallel. The B+ voltage, which is contemplated as being a simple 9-volt battery, is applied as indicated to comparator 75 and AC/AC inverter 67, as well as to trigger control circuit 68.

In operation, assuming storage capacitor 59 is fully charged, when on/off switch 114 is closed a positive voltage is applied to gate 108 of SCR 104 causing the SCR to immediately conduct causing the entire voltage on the storage capacitor to be applied across flash lamp 103, resulting in a bright flash of extremely short duration. This conduction is substantially instantaneous and the circuit then senses, through feedback loop 73 and circuit 74, that the voltage is a lower than desired full-charge level and will immediately trigger oscillator 65 into operation to recharge the capacitor. When the capacitor reaches the desired full charge, typically 450 volts, the feedback network 74 and comparator 75 sense that the desired voltage has been reached and disable the oscillator, thereby saving battery power. Due to leakage over a period of time, the charge on capacitor 59 may be reduced somewhat. This circuit can be adjusted to detect as little as four to six volts decrease in the charge in capacitor 59 and again through comparator 75 actuate oscillator 65 to bring the charge up to its full desired value.

As indicated previously, there are some flash lamp devices which turn the charging circuit off when the storage capacitor is fully charged. Many of these systems allow the charge on the storage capacitor to be reduced by twenty to twenty-five volts before recharging occurs, due to several possible factors inherent in their circuitry. Because of the precision, simplicity and efficiency of the components and the circuits of the present invention, a charge reduction of four to six volts will be detected by the feedback network and comparator, resulting in recharging the storage capacitor. Frequent, small increment charging uses very little energy, much less than larger amounts of charging which occur less often. Another advantage of the present system is that the charge on the storage capacitor is always up to or near peak so there is no danger that the flash tube would be actuated at a low point, as much as five percent below peak, which could result in less than the desired brightness of flash.

Basically, the prior art devices having an intended similar function are typically much less precise than the present invention and some of them are very temperature sensitive so that the feedback voltage necessary to actuate the charging oscillator could vary greatly with temperature. This is especially true for those devices which depend on the leakage characteristics of a transistor to terminate the charging function. The feedback network and comparator of the present invention are extremely precise and efficient so that very little energy is used while at the same time the charge on the storage capacitor is maintained at the desired level with an extremely low variation. The switching technology used in this invention is very efficient and precise compared with linear technology or flyback transformers previously used.

With specific reference now to FIG. 10 there is shown a schematic of a circuit constructed in accordance with the principals of FIGS. 8 and 9, where this particular circuit is designed to be used on a toy laser pistol. The peculiar requirements of such a toy is that the high intensity flash be available for immediate energization upon pulling a trigger or otherwise actuating the circuitry, and that it recharge quickly so that the toy can be repeatedly "fired". Additionally, the circuit of FIG. 10 includes a sound output which is an optional feature.

While the values of the components might differ to a certain extent, there is no substantial difference between the flash circuitry of FIG. 10 and the generalized form of FIG. 9. Storage capacitor 59 is connected across flash lamp 61 which is actuated by trigger circuit 63. The storage capacitor is charged through AC/DC convertor and voltage multiplier circuit 71, the output of which is typically 450 volts DC. Oscillator 65 provides the switching necessary for operation of DC/AC inverter 67 and feedback and comparator circuits 74 and 75, respectively, function as previously described. The waveform out of the oscillator shows a square wave with a duty cycle having a 4:1 ratio. This is typical but is not an absolute requirement. This enables the FET in inverter 67 to conduct 80% of the time, thus providing for very rapid charging of the storage capacitor. The 20% off time provides short periods to allow stored energy in the magnetic field to be transferred to the voltage multiplier. The inverter output would have a similar form but amplified to 100–150 volts.

The power supply 115 is comprised of two batteries 123 and 124 and the positive terminal 125 is connected to the trigger circuit through enable or on/off switch 126 and trigger switch 127. For operation of the circuit, the on/off switch will be placed in an "on" position to provide charging of storage capacitor 59 by means of the connection from the on/off switch through wire 131 and wire 132 to the top portion of coil 133 in inverter 67.

For the sound circuit, speaker 134 is powered through an audio driver stage comprising two transistors 135 and 136 which are connected to transistor 137. A set of three Schmitt trigger elements 141, 142 and 143 are connected between power supply 115 and noise chip 144, one output of which is connected to the common bases of transistors 135 and 136. The noise chip is a conventional off the shelf item, one example of which is an SN9428. The chip establishes the character of the noise including frequency and other characteristics. The first two Schmitt trigger elements, 141 and 142, function as a monostable one shot multivibrator. The speaker generates the desired noise, powered by the power supply 115 for about one second. The time for the noise is governed by a timer circuit comprised of resistor 145 and capacitor 146 in the multivibrator. The output of Schmitt trigger element 143 is the actual trigger output, applied to the circuit represented by chip 144.

Each time the trigger switch 127 is closed after on/-off switch 126 has been closed, flash lamp 61 emits a short, bright flash and speaker 134 emits a burst of sound simultaneously with the flash. After the storage capacitor is charged a DC voltage of about 350 volts exists on line 147 and line 151 has a steady 450 volts applied to it. At the instant of closing trigger switch 127, the voltage from power supply 115 is applied to gate 152 of SCR 153, causing it to conduct and the lamp to flash. At that instant, time $t_o$, the voltage on both of lines 147 and 151 drops to zero, and then builds back quickly asymptotically to the normal values as shown by the associated waveforms. As soon as the flash tube fires, the feedback network and comparator function to commence operation of the oscillator, thereby recharging storage capacitor 59. This is normally accomplished within about one second, whereby the toy gun is then available for "firing" again with another brilliant flash.

The toy laser weapon presents a realistic simulation of a real laser weapon. The collimated beam, bouncing reflections in the barrel, and the sound create an unusual and impressive effect. The target vest enables the visual indication of the hit and provides a light reflective safety garment.

In view of the above description, it is likely that improvements and modifications will occur to those skilled in the art which are within the scope of the accompanying claims.

We claim:

1. A toy laser weapon comprising:

handle means including grip means for gripping by the user;

elongated, substantially transparent barrel means having its proximal end mounted to and extending from said handle means;

flash lamp means within said weapon positioned to selectively project light through said barrel means;

a DC power source in said weapon;

flash lamp actuating means in said weapon for selectively, substantially instantaneously firing said flash lamp means for a single burst of high intensity light;

enabling switch means for selectively connecting said DC power source to said flash lamp actuating means for energizing said flash lamp actuating means when said weapon is in use to enable said flash lamp means to selectively emit a single burst of light immediately upon being triggered;

trigger switch means mounted to said handle means and connected to selectively actuate said energized flash lamp actuating means substantially instantaneously upon closing said trigger switch means to fire said flash lamp means, said flash lamp means including means to disable ability of said flash lamp means to fire when said trigger switch means is closed and when said enabling switch is open;

said flash lamp actuating means comprising:

storage capacitor means connected across said flash lamp means through said enabling switch means so that said storage capacitor means remains substantially uncharged when said enabling switch means is open; means coupled between said DC power source and said storage capacitor means for developing a charging voltage and applying said voltage to said storage capacitor means;

means to maintain said storage capacitor means at substantially full charge and to recharge said storage capacitor means immediately upon discharge through said trigger switch means when said enabling switch means is closed; and said charge maintaining means comprising feedback means coupled between said storage capacitor means and said charging voltage developing means.

2. The toy laser weapon recited in claim 1 and further comprising sound generating means positioned in said weapon and connected to said trigger switch means and DC power source for generating an audio signal when said flash lamp means is fired.

3. The toy laser weapon recited in claim 1 and further comprising a fluorescent tip located on the end of said barrel means for glowing after the burst of high intensity light has been fired.

4. The toy laser weapon recited in claim 1 wherein the weapon is in the form of a pistol and includes grip means for gripping by the user.

5. The toy laser weapon recited in claim 4 wherein the grip means includes a battery compartment and said DC power source is located in said battery compartment; and cover means is positive over said battery compartment to removably close said battery compartment.

6. The toy laser weapon recited in claim 1 wherein said flash lamp actuating means further comprises:

oscillator means coupled to said source of DC power;

a DC/AC inverter connected to the output of said oscillator means and to said DC power source;

an AC/DC converter and voltage multiplier connected between said DC/AC inverter and said storage capacitor means;

comparator means connected between said feedback network and said oscillator; and means for coupling the voltate output from said voltage multipler to said feedback network, said comparator means actuating said oscillator means when a predetermined reduction in the voltage on said storage capacitor means is detected.

7. The toy laser weapon recited in claim 6 wherein said trigger switch means comprises a trigger circuit connected between said flash lamp and said source of DC power.

8. The toy laser weapon recited in claim 6 wherein said oscillator operates in the range of about 20 to 200 KHz.

9. The toy laser weapon recited in claim 6 wherein said DC/AC inverter has an AC output amplified about 10 to 15 times above the voltage value of said DC power source input.

10. The toy laser weapon recited in claim 9 wherein said AC/DC converter converts said AC signal to DC and said voltage multiplier amplifier the voltage input to a level in the range of about 400 to 475 volts.

11. The toy laser weapon recited in claim 6 wherein said feedback network comprises a variable resistor for adjusting the voltage level at which said comparator triggers said oscillator into oscillation.

12. The toy laser weapon recited in claim 6 wherein said comparator comprises a Schmitt trigger.

13. The toy laser weapon recited in claim 6 wherein said DC/AC inverter comprises a filed effect transistor (FET), the conduction of which is controlled by the output of said oscillator.

14. The toy laser weapon recited in claim 13 wherein said DC power is applied to said DC/AC inverter through one end of a coil having a tap intermediate its ends, said FET being connected to said tap, the other end of said coil being connected to said AC/DC converter.

15. The toy laser weapon recited in claim 6 and further comprising a sound circuit adapted to emit a sound substantially simultaneously with a flash of said flash lamp.

16. The toy laser weapon recited in claim 15 wherein said sound circuit comprises a speaker powered by an audio driver.

17. The toy laser weapon recited in claim 6 wherein the predetermined reduction in the level of the voltage on said storage capacitor is about 1% of the desired level.

18. The toy laser weapon recited in claim 1 wherein said flash lamp actuating means comprises means for maintaining said flash lamp actuating means substantially at the desired energization level.

19. The toy laser weapon recited in claim 1 and further comprising means for forming the burst of high intensity light into a light beam extending out the distal end of said barrel means.

20. The toy laser weapon recited in claim 19 wherein said light forming means comprises a collimating means positioned between said flash lamp means and the distal end of said barrel means.

21. The toy laser weapon recited in claim 1 wherein said barrel means is hollow.

22. The toy laser weapon recited in claim 21 and further comprising reflective particles dispersed along the inside of said barrel means.

23. The toy laser weapon recited in claim 1 wherein said flash lamp actuating means comprises electrical charge storage means capable of rapid discharge.

24. The toy laser weapon recited in claim 1 and further comprising:

target means spaced a distance from said weapon;

fluorescent target means mounted on said target means to indicate when the light beam from said weapon hits the target means.

25. The toy laser weapon recited in claim 24 wherein the fluorescent target means is included on a garment that is worn by a person.

26. The toy laser weapon recited in claim 25 wherein the fluorescent target means is on a vest type garment which also serves as a safety garment by lighting up in a vehicle light beam when worn at night.

27. A toy laser weapon comprising:

handle means including grip means for gripping by the user;

hollow, elongated, transparent barrel means having its proximal end mounted to and extending from said handle means;

flash lamp means within said weapon positioned to project light through said barrel means;

a DC power source in said weapon;

flash lamp actuating means in said weapon for selectively, substantially instantaneously firing said flash lamp means for a single burst of high intensity light, said flash lamp actuating means comprising:

storage capacitor means connected across said flash lamp means;

oscillator means coupled to said source of DC power;

a DC/AC inverter connected to the output of said oscillator means and to said DC power source;

an AC/DC converter and voltage multiplier connected between said DC/AC inverter and said storage capacitor means;

a feedback network;

comparator means connected between said feedback network and said oscillator means; and means for coupling the voltage output from said voltage multiplier to said feedback network, said comparator means actuating said oscillator means when a predetermined reduction in the voltage on said storage capacitor means is detected, whereby said storage capacitor means is maintained at a desired voltage level sufficient to actuate said flash lamp means as desired;

means for selectively energizing said flash lamp actuating means when said weapon is in use to enable said flash means to selectively emit a single burst of light immediately upon actuation of a trigger switch means, wherein said;

trigger switch means is mounted to said handle means and connected to selectively actuate said flash lamp actuating means substantially instantaneously upon closing said trigger switch means to fire said flash lamp means; and means for forming the burst of high intensity light into a light beam extending out the distal end of said barrel means.

28. The toy laser weapon recited in claim 27 wherein said trigger switch means comprises a trigger circuit connected between said flash lamp and said source of DC power.

29. The toy laser weapon recited in claim 24 wherein said oscillator operates in the range of about 20 to 200 KHz.

30. The toy laser weapon recited in claim 27 wherein said DC/AC inverter has an AC output amplified 10 to 15 times above the voltage value of said DC power source input.

31. The toy laser weapon recited in claim 27 wherein said AC/DC converter converts said AC signal to DC and said voltage multiplier amplifies the voltage input to a level in the range of about 400 to 475 volts.

32. The toy laser weapon recited in claim 27 wherein said feedback network comprises a variable resistor for adjusting the voltage level at which said comparator triggers said oscillator into oscillation.

33. The toy laser weapon recited in claim 27 wherein said comparator comprises a Schmitt trigger.

34. The toy laser weapon recited in claim 27 wherein said DC/AC inverter comprises a field effect transistor (FET), the conduction of which is controlled by the output of said oscillator.

35. The toy laser weapon recited in claim 34 wherein said DC power is applied to said DC/AC inverter through one end of a coil having a tap intermediate its ends, said FET being connected to said tap, the other end of said coil being connected to said AC/DC converter.

36. The toy laser weapon recited in claim 27 and further comprising a sound circuit adapted to emit a sound substantially simultaneously with the flash of said flash lamp.

37. The toy laser weapon recited in claim 36 wherein said sound circuit comprises a speaker powered by an audio driver.

38. The toy laser weapon recited in claim 27 wherein the predetermined reduction in the level of the voltage on said storage capacitor is about 1% of the desired level.

* * * * *